US008899499B2

(12) United States Patent
Schilder

(10) Patent No.: US 8,899,499 B2
(45) Date of Patent: Dec. 2, 2014

(54) SPRAY RING AND REACTOR VESSEL PROVIDED WITH SUCH A SPRAY RING AND A METHOD OF WETTING CHAR AND/OR SLAG IN A WATER BATH

(71) Applicant: Shell Oil Company, Houston, TX (US)

(72) Inventor: Johannes Gerardus Maria Schilder, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/045,397

(22) Filed: Oct. 3, 2013

(65) Prior Publication Data

US 2014/0027529 A1 Jan. 30, 2014

Related U.S. Application Data

(62) Division of application No. 10/580,643, filed as application No. PCT/EP2004/053148 on Nov. 29, 2004, now Pat. No. 8,579,212.

(30) Foreign Application Priority Data

Nov. 28, 2003 (EP) ..... 03104450

(51) Int. Cl.

| | |
|---|---|
| ***B01J 7/00*** | (2006.01) |
| ***B05B 1/34*** | (2006.01) |
| ***B05B 1/14*** | (2006.01) |
| ***C10J 3/48*** | (2006.01) |
| ***C10K 1/10*** | (2006.01) |
| ***C10J 3/52*** | (2006.01) |
| ***C10J 3/84*** | (2006.01) |

(52) U.S. Cl.

CPC ..... *C10J 3/485* (2013.01); *C10J 2300/1807* (2013.01); *C10K 1/101* (2013.01); *C10J 3/52* (2013.01); *C10J 3/845* (2013.01)

USPC ..... 239/468; 48/61; 48/197 R; 239/461; 239/558

(58) Field of Classification Search

USPC ..... 48/61, 197 R; 239/461, 468, 558

See application file for complete search history.

(56) References Cited

U.S. PATENT DOCUMENTS

| | | | |
|---|---|---|---|
| 4,000,753 | A | 1/1977 | Ellis |
| 4,046,541 | A | 9/1977 | Anderson |
| 4,071,329 | A | 1/1978 | Eales |
| 4,425,254 | A | 1/1984 | Langhoff et al. |
| 4,828,578 | A | 5/1989 | Bleyker |
| 5,271,243 | A | 12/1993 | Jelich |
| 5,755,838 | A | 5/1998 | Tanaka et al. |

FOREIGN PATENT DOCUMENTS

| | | | |
|---|---|---|---|
| EP | 0318071 | A1 | 5/1989 |
| EP | 0374323 | A1 | 6/1990 |
| EP | 0377930 | A1 | 7/1990 |

OTHER PUBLICATIONS

International Search Report PCT/EP2004/053146 dated Mar. 1, 2005.

*Primary Examiner* — Matthew Merkling

(57) ABSTRACT

A spray ring, for wetting char and/or slag in a water bath with a wetting fluid. The spray ring comprises a loop conduit arranged in a loop-line. The loop conduit is at an inlet point provided with an inlet for feeding the wetting fluid into the loop conduit in an inlet flow direction. The loop-line has a plurality of outlet openings for spraying the wetting fluid out of the loop conduit. The inlet flow direction has a component that is tangential to a loop-line flow direction of the wetting fluid through the loop conduit at the inlet point.

3 Claims, 2 Drawing Sheets

SPRAY RING AND REACTOR VESSEL PROVIDED WITH SUCH A SPRAY RING AND A METHOD OF WETTING CHAR AND/OR SLAG IN A WATER BATH

PRIORITY CLAIM AND CROSS REFERENCE

The present application is a divisional of U.S. patent application Ser. No. 10/580,643 filed Feb. 6, 2007, which is a 35 U.S.C. §371 national stage filing of PCT/EP2004/053148 filed Nov. 29, 2004, which claims benefit of European patent application No. 03104450.6 filed Nov. 28, 2003.

FIELD OF THE INVENTION

The present invention relates to a spray ring for wetting char and/or slag in a water bath, comprising a loop conduit arranged in a loop-line.

The present invention also relates to a reactor vessel provided with such a spray ring.

The present invention also relates to a method of wetting char and/or slag in a water bath.

BACKGROUND OF THE INVENTION

Such a spray ring and wetting method may be used in a gasification reactor of a coal gasification plant, or in any other reactor wherein char and/or slag is quenched in a water slag bath. For the purpose of this specification, char refers to solid ash and slag refers to liquid ash.

In a coal gasification plant a pulverised carbonaceous fuel, such as coal, is transformed into a product gas consisting mainly of synthesis gas. The gasification plant typically comprises a gasification reactor, or gasifier, wherein the pulverised carbonaceous fuel is gasified under high pressure and high temperature conditions. In such a gasifier, a wall surface is provided on which a slag can form out of the ashes. Such a wall surface can be provided in the form of a membrane wall.

The slag is allowed to drip down along the wall surface, where it is collected in a slag water bath where it can cool and solidify. In the art, a spray ring is used to spray the slag particles on or near the water surface of the slag water bath, for facilitating the sinking of the slag for removal from below the slag water bath.

A spray ring for use as a wetting device for wetting char and slag in a slag water bath below a coal gasification reactor is described in European patent application EP-A 0 318 071. This spray ring is based on a circular conduit extending in a horizontal plane. The spray ring contains recycled water from the slag bath, and possibly a wetting agent, and is provided with threaded ports for holding changeable nozzles. The circular conduit is connected to a supply duct for supplying the water, which extends perpendicularly from the circular conduit out of the plane in which the circular conduit extends. The nozzles must have a diameter that lies within a predetermined range in order to yield a sufficient velocity of the sprayed water while preventing the nozzles from plugging with solids contained in the water recycled to the circular conduit.

The spray ring described in EP-A 0 318 071 suffers from settlement of solid particles from the recycled water.

SUMMARY OF THE INVENTION

In a first aspect of the invention there is provided a spray ring, for wetting char and/or slag in a water bath with a wetting fluid, the spray ring comprising a loop conduit arranged in a loop-line, which loop conduit is at an inlet point provided with an inlet for feeding the wetting fluid into the loop conduit in an inlet flow direction, and with a plurality of outlet openings for spraying the wetting fluid out of the loop conduit, wherein the inlet flow direction has a component that is tangential to a loop-line flow direction of the wetting fluid through the loop conduit at the inlet point.

Due to the loop-line arrangement of the spray ring, the wetting fluid can circulate through the spray ring. By arranging the inlet flow direction to have a component that is tangential to the circulation flow direction of the wetting fluid through the spray ring, the circulation of the wetting fluid through the spray ring is induced or at least enhanced. Settlement of solid particles that may be entrained in the wetting fluid is prevented or reduced by inducing or at least enhancing the circulation.

In the method of the invention, a loop-conduit-comprising spray ring arranged in a loop-line is provided gravitationally higher than the water bath, and wherein the wetting fluid is circulated through the spray ring along a loop-line flow direction by feeding the wetting fluid into the loop conduit in an inlet flow direction having a component that is tangential to the loop-line flow direction of the wetting fluid through the loop conduit, wherein at the same time the wetting fluid is sprayed out of the loop conduit onto the char and/or slag in the water bath.

The spray ring can be arranged in a reactor vessel comprising a reaction area and, disposed gravitationally lower than the reaction area, a slag water bath for holding water and receiving char and/or slag from the reaction area, whereby the spray ring is preferably provided gravitationally lower than the reaction area.

In one embodiment of the present invention, the loop conduit forms a peripheral ambit around an encompassed area and whereby the outlet openings are directed such that the outlet flow direction of the wetting fluid has a component directed inwardly towards the encompassed area. An advantage of this embodiment is that it does not require a dip tube.

In an embodiment of the invention, the conduit forming the loop conduit has an internal cross sectional contour in a plane perpendicular to the loop-line flow direction that is free from a convex section. Herewith, unnecessary flow restriction inside the loop conduit is avoided.

In an embodiment of the invention, one or more of the spray ring's outlet openings are provided with a connecting flange for holding flange-connectable nozzles. Unlike thread-connectable nozzles, flange-connectable nozzles are easily replaceable when corroded. When the flanges are for instance bolted together, the connecting bolts can be cut and replaced when corrosion prevents normal unbolting.

It is remarked that such flange connectable nozzles can also advantageously be provided on a spray ring known from the prior art not that do not have the tangential component in the inlet flow direction relative to the loop-line flow direction.

According to a second aspect of the invention, there is provided a reactor vessel comprising a reaction area and, disposed gravitationally lower than the reaction area, a slag water bath for holding water and receiving char and/or slag from the reaction area, and a spray ring according to the first aspect of the invention.

Preferably, the reactor vessel is provided with an inlet port for connecting to a wetting fluid supply, whereby the inlet port is located gravitationally higher than the spray ring, and wherein the inlet opening of the spray ring is connected to the inlet port via an internal supply conduit. Herewith a self-draining spray system is provided which drains due to the gravitational difference between the inlet port and the outlet openings in the spray ring.

The self-draining capacity is further improved in an embodiment wherein the internal supply conduit extends exclusively non-horizontally, in order to avoid accumulation of wetting fluid somewhere in the internal supply conduit.

The invention further relates to a distribution box for connecting one or more supply conduits to an inlet port, the distribution box comprising first connecting means for connecting to the inlet port, and second connecting means for connecting the distribution box to the one or more supply conduits, wherein the distribution box is provided with an access port in a wall part opposite one of the supply conduits essentially aligned with the one of the supply conduits.

Due to the mutual alignment, the access port thus provides access to the supply conduit for inspection and cleaning purposes. A cleaning hose, for instance a water jetting hose, can for instance be inserted into the supply conduit via the access port, without having to disconnect the supply conduit from the distribution box or the distribution box from the inlet port.

The invention will be described hereinafter in more detail and by way of example, with reference to the accompanying drawings in which:

DETAILED DESCRIPTION OF EMBODIMENTS

In the Figures like reference signs relate to like components.

A spray ring is provided for wetting char and/or slag in a water bath with a wetting fluid, the spray ring comprising a loop conduit arranged in a loop-line, which loop conduit is at an inlet point provided with an inlet for feeding the wetting fluid into the loop conduit in an inlet flow direction, and with a plurality of outlet openings for spraying the wetting fluid out of the loop conduit.

The spray ring can be arranged in a reactor vessel comprising a reaction area and, disposed gravitationally lower than the reaction area, a slag water bath for holding water and receiving char and/or slag from the reaction area, whereby the spray ring is preferably provided gravitationally lower than the reaction area.

In one embodiment of the present invention, the loop conduit forms a peripheral ambit around an encompassed area and whereby the outlet openings are directed such that the outlet flow direction of the wetting fluid has a component directed inwardly towards the encompassed area. An advantage of this embodiment is that it does not require a dip tube.

In an embodiment of the invention, the conduit forming the loop conduit has an internal cross sectional contour in a plane perpendicular to the loop-line flow direction that is free from a convex section. Herewith, unnecessary flow restriction inside the loop conduit is avoided.

In an embodiment of the invention, one or more of the spray ring's outlet openings are provided with a connecting flange for holding flange-connectable nozzles. Unlike thread-connectable nozzles, flange-connectable nozzles are easily replaceable when corroded. When the flanges are for instance bolted together, the connecting bolts can be cut and replaced when corrosion prevents normal unbolting.

It is remarked that such flange connectable nozzles can also advantageously be provided on a spray ring known from the prior art not that do not have the tangential component in the inlet flow direction relative to the loop-line flow direction.

Figure 1:
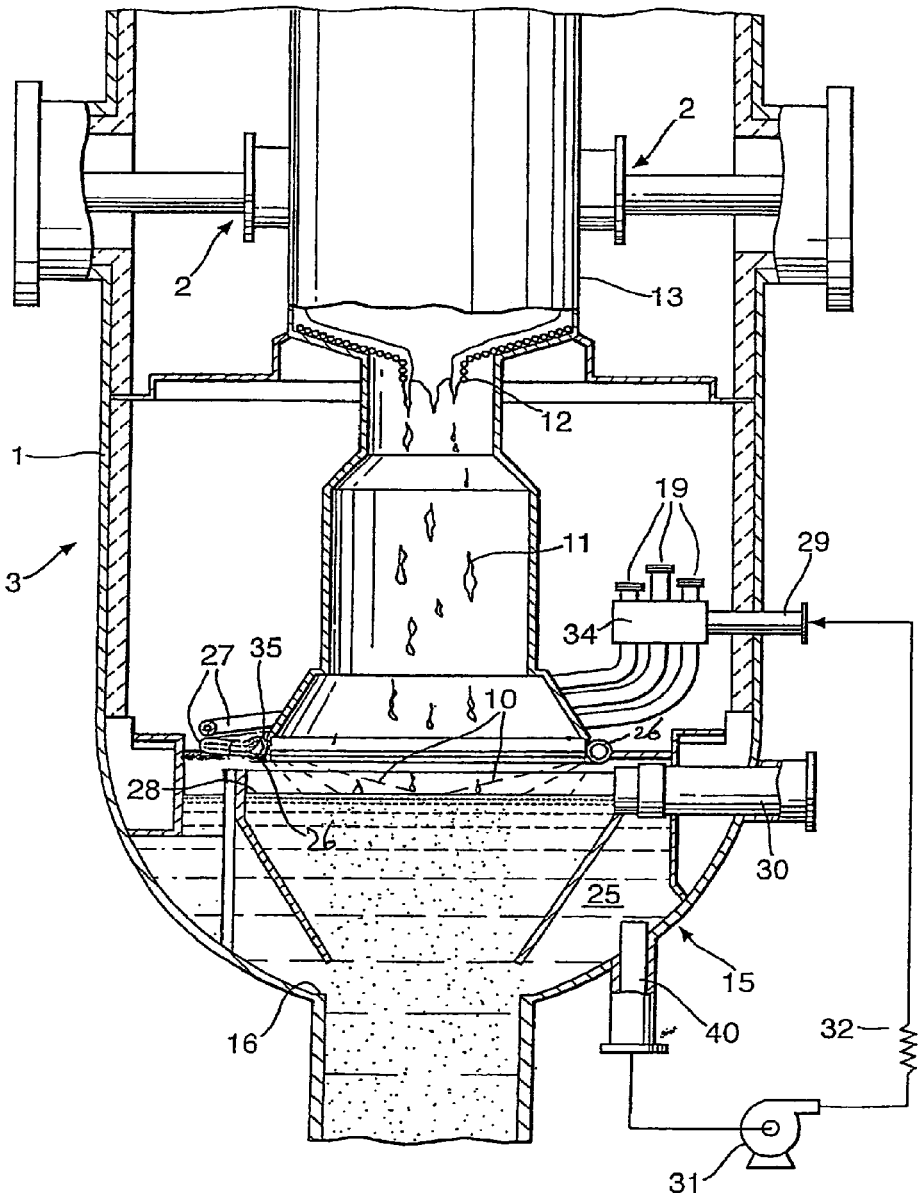
FIG. 1 schematically shows part of a gasification reactor in cross section.

Referring to FIG. 1 there is schematically shown a bottom end of a gasification reactor in the form of gasifier 3 for the generation of synthesis gas. In a coal gasification plant this generally occurs by partially combusting a carbonaceous fuel, such as coal, at relatively high temperatures in the range of 1000° C. to 3000° C. and at a pressure range of about 1 to 70 bar, preferably 7 to 70 bar, in the presence of oxygen or oxygen-containing gases in the coal gasification reactor. The gasifier 3 may be a vertical oblong vessel, having a pressure vessel with an outer shell 1, preferably cylindrical in the burner area, with substantially conical or convex upper and lower ends. A reactor area is defined by a surrounding membrane wall structure 13 for circulation of cooling fluid. Typically, the gasifier will have burners 2 in diametrically opposing positions, but this is not a requirement of the present invention.

Regulation of gasifier and outlet temperature is assisted by a coolant in the membrane wall structure 13. The membrane wall structure 13 assists in separating incombustible ash from the fuel during the combustion of the fuel. A slag is formed on the membrane wall structure 13 and allowed to drip down to a slag tap 12, from where the slag 11 is being discharged downwardly into a slag water bath 15.

The flow of slag is passed to discharge opening 16 of the slag water bath where it is discharged together with water 25. Floating slag remains can be decanted from the water surface 28 via conduit 30.

Water 25 is also drawn into pipe 40 at an elevation above the discharge opening 16 of the slag bath 15. The water 25 is withdrawn via pipe 40 at a sufficiently low velocity so as not to entrain slag in the recycled water 25. The water 25 is recycled back to the water bath, preferably via a pump 31 and heat exchanger 32 prior to routing the water to inlet port 29 which is fluidly connected to a spray ring 26 located above the water surface 28. The spray ring 26 is arranged to form a spray 10 of the recycled water directed to the water surface 28 for wetting the char and/or slag that may be present on the water surface 28 to facilitate removal of the char and/or slag from the water bath 15. The spray ring 26 defines a peripheral ambit around an encompassed area, and is located such that slag and/or char 11 dropping from the reactor area (for instance via slag tap 12) passes through the encompassed area. The spray ring is connected to a distribution box 34 by means of internal supply conduits 27, which distribution box is internally to the reactor's outer shell 1 connected to the inlet port 29. The spray ring 26 and its connection to the internal supply conduits 27 are described in further detail below with reference to FIG. 2.

Figure 2:
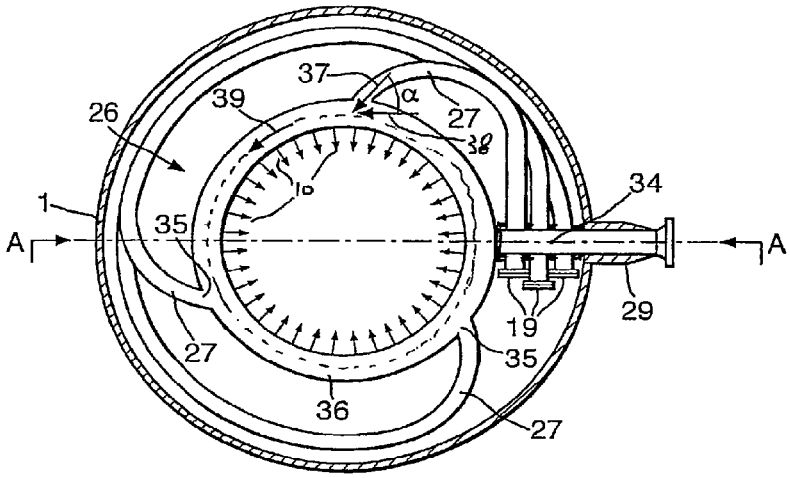
FIG. 2 schematically shows a top view of a spray ring.

Referring to FIG. 2, the spray ring 26 comprises a loop conduit 36 arranged in a loop-line. The loop-line is preferably of circular shape, preferably forming a torus or a ring-shaped conduit. Other loop-line shapes can be used. The spray ring 26 is provided with replaceable nozzles to generate the spray 10. These nozzles will be described below with reference to FIG. 4.

Still referring to FIG. 2, the loop conduit 36 is at three inlet points provided with an inlet 35 for feeding the wetting fluid into the loop conduit 36 in an inlet flow direction 37. The inlet flow direction 37 has a component that is tangential to a loop-line flow direction 38 of the wetting fluid through the loop conduit 36 at the inlet point. The included angle $\alpha$ between the inlet flow direction 37 and the loop-line flow direction 38 in each inlet point 35 is less than 90°, preferably less than 80°, and more preferably less than 50°. In the embodiment of FIG. 2, the included angle $\alpha$ is 45°.

Also, in the embodiment of FIG. 2, the centre line of the spray ring and the centre lines of the internal supply conduits are located in the same horizontal plane such that the inlet openings 35 are provided in the outer peripheral wall of the loop conduit 36.

A different number of inlet points 35 than three as described above, such as a single inlet point or two inlet points of four inlet points, can be provided. Preferably, the inlet points are equally distributed along the loop conduit 36. A plurality of inlet points has the effect that the wetting fluid passes through each of the outlet openings in essentially equal amounts.

Figure 3:
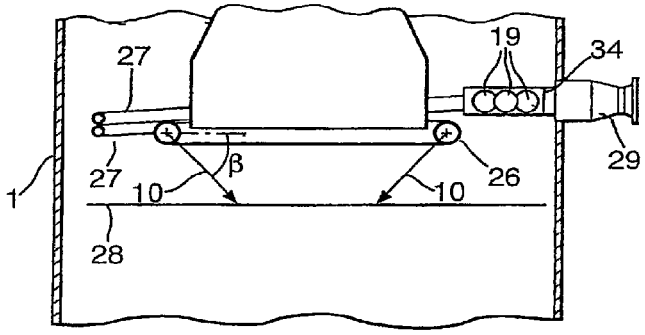
FIG. 3 schematically shows a cross section of the spray ring of FIG. 2 along line A-A.

Referring now to FIGS. 1 to 3, the internal supply conduits 27 lead to a single distribution box 34. This minimises the amount of distribution piping required on the outside of the outer shell 1, which is subject to erosion. The distribution box 34 is connected to the inlet port 29, which is located gravitationally higher than the spray ring 29. This allows for self-draining capability of the internal supply conduits 27. The self-draining capability is further facilitated by the exclusively non-horizontal trajectory of the internal supply conduits 27 from the distribution box 34 to the inlet openings 35.

FIG. 3 in particular shows a cross sectional view of the conduit that forms the loop conduit. The section is made in the plane that is perpendicular to the loop line flow direction where the section is made. Generally, an internal cross sectional contour is present that is free from any convex section such as an internal gutter or a separation plane. Preferably, the internal cross sectional contour is fully concave, such a circular or oval.

The loop conduit 36 is provided with outlet openings, whereby the outlet openings are directed such that the outlet flow direction of the wetting fluid has a component directed inwardly towards the encompassed area. Preferably the outlet openings are directed downwardly and inwardly towards the discharge opening 16 in order to facilitate the char and/or slag transport towards the discharge opening 16. Suitably, the outlet openings are provided with spray nozzles. FIG. 4 shows two possible nozzle arrangements.

Figure 4A:
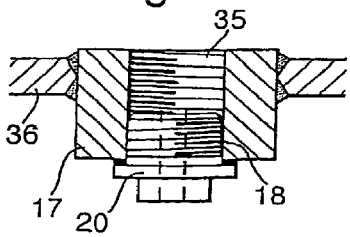
FIG. 4 (parts *a* and *b*) schematically shows nozzle arrangements in cross section.

FIG. 4*a* schematically shows a cross section of a nozzle that is connectable to the loop conduit 36 via thread connection 18 in a threaded orifice 17.

Figure 4B:
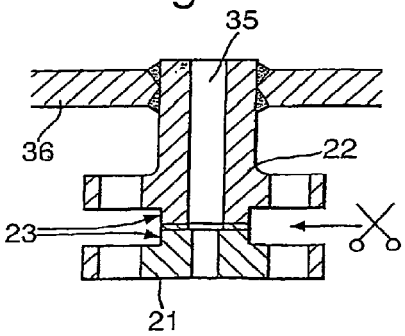

FIG. 4*b* schematically shows a connecting flange 22 for holding a flange-connectable nozzle 21. The flange-connectable nozzle 21 can be a blind flange provided with a suitable nozzle opening.

It is recognized that various combinations of the above configurations could be used such as nozzles of different diameters and forces, angles $\beta$ of impingement, etc.

Both the threaded orifice 17 and the flanged opening 22 provide the capability of replacing the nozzle 20,21 with another nozzle having a different diameter and/or different angle of impingement with respect to the horizontal as shown in FIGS. 3 and 4 of EP-A 0 318 071 which are herewith incorporated by reference. The force for sinking the char and/or slag to the discharge opening 16 can herewith be optimized.

The flange-connectable nozzle of FIG. 4*b* has an advantage of removability. When the threads of the bolts connecting the flanges 21 and 22 suffer from corrosion, the bolts can be cut as schematically indicated. Spacing between the flanges 21 and 22 for allowing cutting access can be provided by kiss-sections 23.

In operation, the spray ring works as follows. Wetting fluid is supplied via inlet port 29 to the distribution box 34 wherein the wetting fluid is distributed over the available internal supply conduits 27. The wetting fluid is then led into the loop conduit 36 in the inlet points 35 whereby the inlet flow direction has a component that is tangential to a loop-line flow direction of the wetting fluid through the loop conduit at the inlet point. As a result, the wetting fluid present in the loop conduit 36 starts to circulate as indicated by arrow 39. Thereby, settlements of solid particles inside the loop conduit are prevented.

At the same time, the nozzles generate a number of wetting fluid sprays 10 directed towards the water surface 28. The char and slag particles 11 (FIG. 1) which have fallen into the water bath 15 are agitated to set the particles in motion one against the other. To facilitate coagulation, a coagulant can be added to the water supplied to the internal supply conduits 27. The char and slag particles agglomerate and sink to the bottom of the water bath 15 and are subsequently removed.

The minimum circulation velocity of the wetting fluid in the loop conduit is advantageously 1.0 m/s, which has been found as a lower limit for the purpose of avoiding settlement of slag particles entrained in the wetting fluid. The circulation velocity is best kept below about 2.0 m/s in order to limit erosion caused by the entrained slag particles. A normal diameter of the nozzle opening is typically between 6 mm and 30 mm in order to yield a sufficiently high spray velocity while at the same time preventing the nozzle openings from plugging with solids contained in the wetting fluid. Preferably, the lower limit of the range is 10 mm to ensure avoidance of plugging over a longer period of time. Preferably, the upper limit of the range is 20 mm to allow for some erosion while maintaining the sufficiently high spray velocity.

The ideal angle of impingement of the sprays 10 with the water surface 28 depends on factors including diameter of the loop conduit and height above the water surface 28. Typically an angle $\beta$ with the horizontal of between 40° and 65° can be used.

In one example, the inner diameter of the loop conduit 36 was 193.7 mm (8"), and the inner diameter of the internal supply conduits 27 was 97.2 mm (4"). The nozzle opening diameter was 18 mm and the spray angle was directed 50° with the horizontal.

Referring to FIGS. 1 and 2, the distribution box 34 is connected to the inlet port 29. Access ports are provided in the form of flange connections 19 with blind flanges. These flange connections 19 are located in a wall part of the distribution box 34 opposite the internal supply conduits 27 and are essentially aligned with the internal supply conduits 27. This allows for inspection of the internal supply conduits 27, and facilitates cleaning access to the internal supply conduits 27. In the embodiment of FIG. 1 the axis of alignment between the access openings and the internal supply conduits 27 is vertical, whereas in FIG. 2 the access openings are horizontally aligned with the internal supply conduits 27. Any angle can be used.

U.S. Pat. No. 4,828,578 describes a quench ring encircling a constricted throat formed in a reaction chamber floor. The quench ring is situated in the direct vicinity of an upper rim of a cylindrical dip tube. The quench ring has an internal water circulating channel and has outlet openings located inside the dip tube to direct streams of water outwardly against the inner surface of the dip tube. The diameter of the constricted throat is smaller than that of the quench ring and the dip tube, and therefore slag particles will free fall through the quench ring.

It is thus remarked that the quench ring of U.S. Pat. No. 4,828,578 is not a spray ring arranged to wet char and/or slag in a water bath, but rather a distribution ring to distribute water to cool the dip tube. As a consequence, the water is not sprayed into the water bath but instead it drips down along the dip tube inner wall. Moreover, the quench ring of U.S. Pat. No. 4,828,578 has an internal smaller channel in the form of an internal gutter that is always full of water. The internal smaller channel is associated with a convex protruburant section inside the quench ring.

This poses a problem when particle laden water is circulated, as the internal flow opening through the quench channel is unnecessarily restricted.

What is claimed is:

1. A method of wetting char and/or slag in a water bath with a wetting fluid, comprising:

arranging a spray ring comprising a loop conduit in a loop-line gravitationally higher than the water bath;

circulating the wetting fluid through the spray ring along a loop-line flow direction by feeding the wetting fluid into the loop conduit in an inlet flow direction having a component that is tangential to the loop-line flow direction of the wetting fluid through the loop conduit; and at the same time spraying the wetting fluid out of the loop conduit onto the char and/or slag in the water bath.

2. The method of claim 1, wherein spraying the wetting fluid comprises aiming the wetting fluid at the water surface.

3. The method of claim 1, wherein the loop conduit forms a peripheral ambit around an encompassed area and the wetting fluid is directed inwardly towards the encompassed area when it is sprayed out of the loop conduit.

* * * * *